US010841986B2

(12) United States Patent
Mazzon

(10) Patent No.: US 10,841,986 B2
(45) Date of Patent: Nov. 17, 2020

(54) MICROWAVE OVEN

(71) Applicant: ELECTROLUX APPLIANCES AKTIEBOLAG, Stockholm (SE)

(72) Inventor: Claudio Mazzon, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 218 days.

(21) Appl. No.: 15/780,264

(22) PCT Filed: Nov. 28, 2016

(86) PCT No.: PCT/EP2016/078934
§ 371 (c)(1),
(2) Date: May 31, 2018

(87) PCT Pub. No.: WO2017/093154
PCT Pub. Date: Jun. 8, 2017

(65) Prior Publication Data

US 2018/0359822 A1 Dec. 13, 2018

(30) Foreign Application Priority Data

Dec. 4, 2015 (EP) ..... 15197973

(51) Int. Cl.
*H05B 6/64* (2006.01)
*H05B 6/70* (2006.01)
*H05B 6/72* (2006.01)

(52) U.S. Cl.
CPC ..... *H05B 6/6482* (2013.01); *H05B 6/70* (2013.01); *H05B 6/72* (2013.01)

(58) Field of Classification Search
CPC ..... H05B 6/70; H05B 6/6482; H05B 6/72
(Continued)

(56) References Cited

U.S. PATENT DOCUMENTS 3,388,231 A * 6/1968 Staats ..... H05B 6/642 219/757
2009/0236334 A1 9/2009 Ben-Shmuel et al.
2014/0305933 A1* 10/2014 Tang ..... H05B 6/702 219/696

FOREIGN PATENT DOCUMENTS

EP 1241923 A1 9/2002
EP 1670290 A1 6/2006
(Continued)

OTHER PUBLICATIONS

Translation of EP1241923A1, Microwave oven, Sep. 18,2002, http://dialog.proquest.com/professional (Year: 2002).*
(Continued)

*Primary Examiner* — Quang T Van
(74) *Attorney, Agent, or Firm* — Pearne & Gordon LLP

(57) ABSTRACT

A microwave oven, in particular for a domestic appliance. The microwave oven includes an oven cavity at least partially enclosed by a cavity wall. The microwave oven also includes a microwave generator, in particular a magnetron, arranged out of the oven cavity. A matching section is interconnected between the magnetron and the cavity wall. The matching section covers an opening in the cavity wall. A magnetron antenna extends from the microwave generator into the matching section. At least one antenna extension is arranged inside the oven cavity. The antenna extension penetrates the opening in the cavity wall. The antenna extension is electrically connected to the magnetron antenna.

19 Claims, 11 Drawing Sheets

(58) Field of Classification Search
USPC ..... 219/685, 678, 690, 695, 696, 702, 703, 219/710, 740, 746, 747, 748, 757
See application file for complete search history.

(56) References Cited

FOREIGN PATENT DOCUMENTS

| | | | |
|---|---|---|---|
| EP | 2187702 | A1 | 5/2010 |
| EP | 2778539 | A1 | 9/2014 |
| EP | 2931007 | A1 | 10/2015 |
| GB | 1203297 | A | 8/1970 |

OTHER PUBLICATIONS

International Search Report & Written Opinion issued in corresponding application No. PCT/EP2016/078934 dated Feb. 23, 2017, 11 pages.

* cited by examiner

MICROWAVE OVEN

The present invention relates to a microwave oven, in particular for a domestic appliance.

Microwave ovens are widely used in cooking appliances. Usually, the microwaves are generated by a magnetron arranged out of the oven cavity. A wave guide transports the microwaves from the magnetron to a feeding point in the oven cavity. In order to improve the microwave distribution in the oven cavity, a wave stirrer is arranged inside the wave guide or oven cavity and/or a turntable upon the bottom of the oven cavity supports the food stuff.

Figure 11:
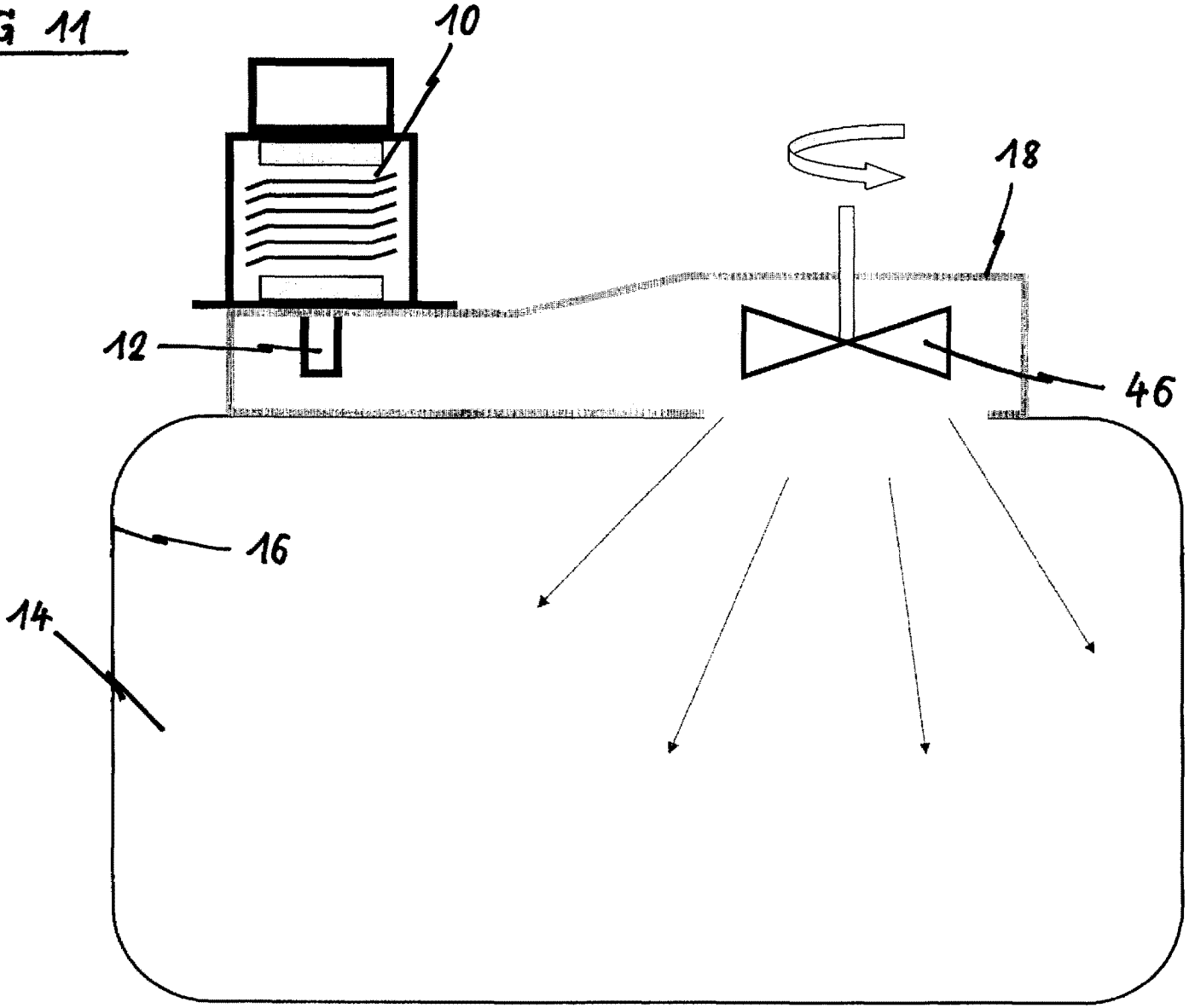

FIG. 11 illustrates a schematic sectional side view of an example of the microwave oven according to the prior art. The microwave oven comprises the magnetron 10 and the magnetron antenna 12 extending from said magnetron 10. Further, the microwave oven comprises the oven cavity 14 and a cavity wall 16 enclosing said oven cavity 14. The magnetron 10 is arranged out of the oven cavity 14. A matching section 18 is interconnected between the magnetron 10 and the cavity wall 16. The matching section 18 is arranged upon the top wall of the oven cavity 14. The magnetron antenna 12 extends into said matching section 18. The wave stirrer 46 is arranged inside the matching section 18 and above a large opening in the top wall of the oven cavity 14.

Figure 12:
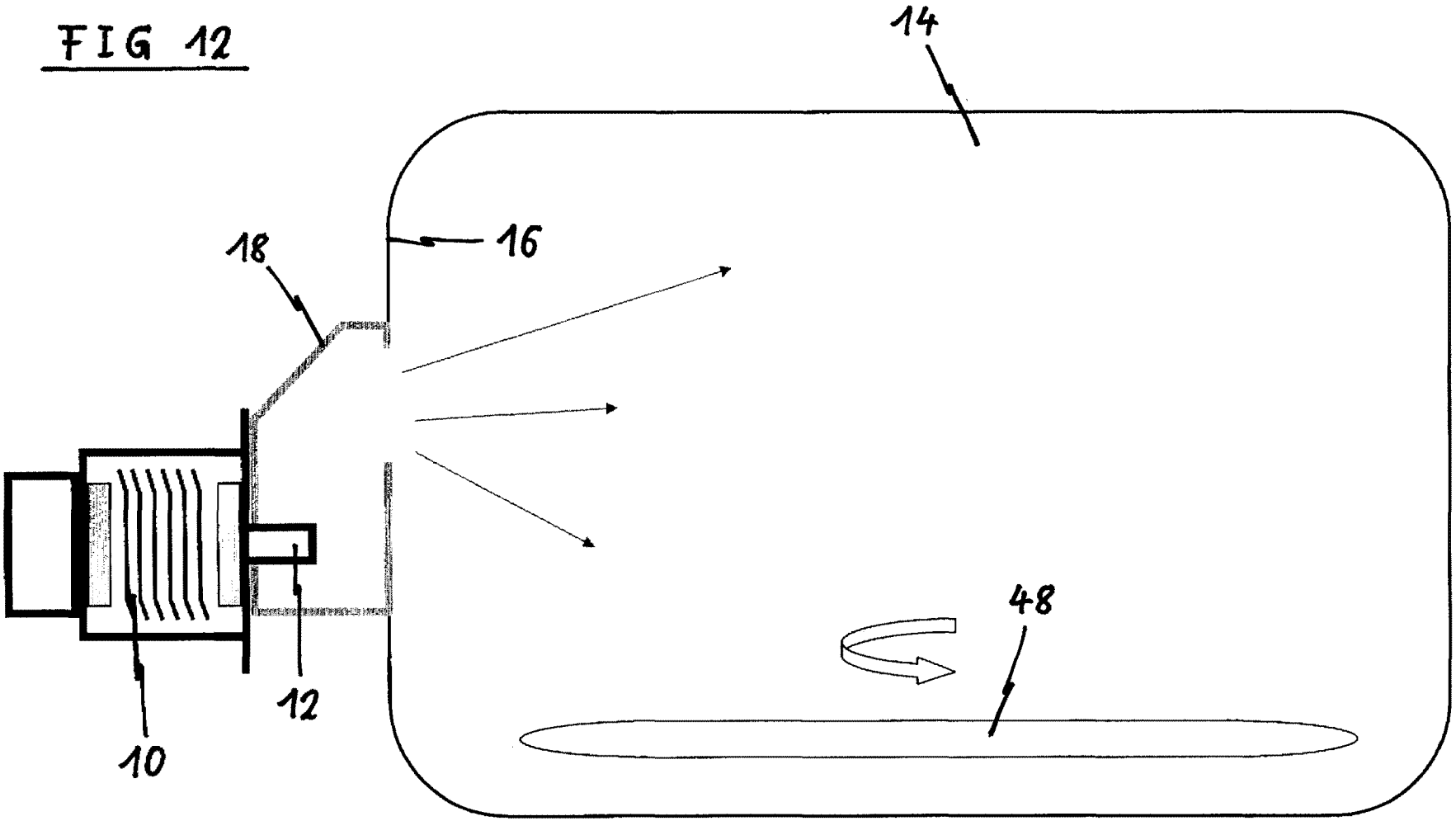

FIG. 12 illustrates a schematic sectional side view of a further example of the microwave oven according to the prior art. The microwave oven comprises the magnetron 10, the magnetron antenna 12 extending from said magnetron 10, the oven cavity 14 and the cavity wall 16 enclosing said oven cavity 14. The magnetron 10 is arranged out of the oven cavity 14. The matching section 18 is interconnected between the magnetron 10 and a large opening in a side wall of the oven cavity 14. The magnetron antenna 12 extends into said matching section 18. The turntable 48 is arranged on the bottom of the oven cavity 14.

The microwave ovens of the prior art as shown in FIGS. 11 and 12 require movable components as the wave stirrer 46 and the turntable 48, respectively, in order to improve the microwave heat distribution. Further, the microwave ovens of the prior art require a large opening in the cavity wall 16. Said large opening reduces the thermal insulation of the oven cavity.

It is an object of the present invention to provide an improved microwave oven, which overcomes the disadvantages mentioned above.

According to the present invention a microwave oven, in particular for a domestic appliance is provided, wherein

- the microwave oven comprises an oven cavity at least partially enclosed by a cavity wall,
- the microwave oven comprises a microwave generator, in particular a vacuum tube such as e.g. a magnetron or an electronic microwave generator such as e.g. a solid state generator, arranged out of the oven cavity,
- a matching section is interconnected between the microwave generator and the cavity wall,
- the matching section covers an opening in the cavity wall,
- a microwave antenna, in particular a magnetron antenna, extends from the microwave generator into the matching section,
- at least one antenna extension is arranged inside the oven cavity,
- the antenna extension penetrates the opening in the cavity wall, and
- the antenna extension is electrically connected to the microwave antenna.

In the context of the present invention a microwave generator of a microwave cooking oven, preferably of a domestic cooking oven, comprises any vacuum tube-type microwave generator such as e.g. a magnetron or any electronic microwave generator such as e.g. a solid state generator, generally any suitable kind of electromagnetic field source such as e.g. a dipole or monopole source that can be used for microwave heating in a cooking oven, in particular in a domestic microwave oven.

The microwave oven according to the present invention is realized without any moveable components. The inventive microwave oven provides more space in the oven cavity. Further, the inventive microwave oven comprises a relative small opening in the cavity wall, which improves the thermal insulation of the oven cavity. Moreover, the inventive microwave oven does not require any complex wave guides.

In particular, an antenna cap is interconnected between the microwave antenna (e.g. magnetron antenna) and the antenna extension, wherein preferably the antenna cap includes a blind hole for receiving the microwave/magnetron antenna.

For example, the antenna extension is arranged inside an upper portion of the oven cavity, wherein preferably said antenna extension is formed as a serpentine.

Further, the antenna extension may be arranged in a plane parallel to and beneath a top wall of the oven cavity, wherein preferably the distance between the antenna extension and the top wall of the oven cavity is $N*\lambda/8$ or comparable with $\lambda/8$, i.e. N is an essentially integral number greater zero, preferably wherein N is essentially 1, 2 or 3, still preferably wherein N is essentially 1, and wherein $\lambda$ is the wavelength of the microwaves.

Relating to the dimensions, an outer diameter of the antenna cap, an inner diameter of the matching section and/or a length of the matching section may be essentially integer multiples of $\lambda/8$, i.e. $N*\lambda/8$ wherein N is an essentially integral number greater zero, preferably wherein N is essentially 1, 2 or 3, still preferably wherein N is essentially 1 and wherein $\lambda$ is the wavelength of the microwaves.

Moreover, at least the outer surface of the antenna extension may be made of electrically conductive material, wherein preferably the antenna extension is hollow and made of copper or steel.

In particular, the cavity wall of the oven cavity is grounded.

According to another embodiment, the microwave oven comprises at least one further antenna extension arranged inside the oven cavity, wherein said further antenna extension is electrically connected to the antenna extension.

For example, the further antenna extension is an electric heating element, in particular a grill heating element, wherein preferably the further antenna extension is arranged in a plane parallel to and beneath the top wall of the oven cavity, and wherein preferably the distance between the further antenna extension and the top wall of the oven cavity is $\lambda/8$ or $N*\lambda/8$, wherein N is an essentially integral number greater zero, preferably wherein N is essentially 1, 2 or 3, still preferably wherein N is essentially 1 and $\lambda$ is the wavelength of the microwaves. Alternatively or additionally, a side grid, a support grid or any other electrically conductive components in the oven cavity may be used as further antenna extension.

In particular, the further antenna extension includes a tubular outer sheath and an elongated electric heating coil arranged inside said outer sheath, wherein at least a part of the outer sheath is electrically connected to the antenna extension and said heating coil is connected or connectable to a power supply, and wherein preferably the outer sheath and the heating coil are arranged coaxially to each other.

Moreover, the further antenna extension includes an insulating powder inside the outer sheath, so that the heating coil and the outer sheath are electrically isolated from each other.

Especially, the outer sheath includes an inner part and two outer parts, wherein the inner part is arranged inside the oven cavity and the outer parts penetrate the cavity wall, and wherein the inner part is electrically connected to the antenna extension and the outer parts are electrically connected to the cavity wall.

In this case, the inner part and the outer part may be connected by a separating element made of one or more insulating materials, wherein preferably the distance between the inner part and the outer part is between 1 mm and 2 mm.

Moreover, each outer part of the outer sheath may be enclosed by a flange connected or connectable to the cavity wall of the oven cavity.

Preferably, a connecting element is interconnected between the inner part of the outer sheath and the antenna extension.

Novel and inventive features of the present invention are set forth in the appended claims.

Figure 1:
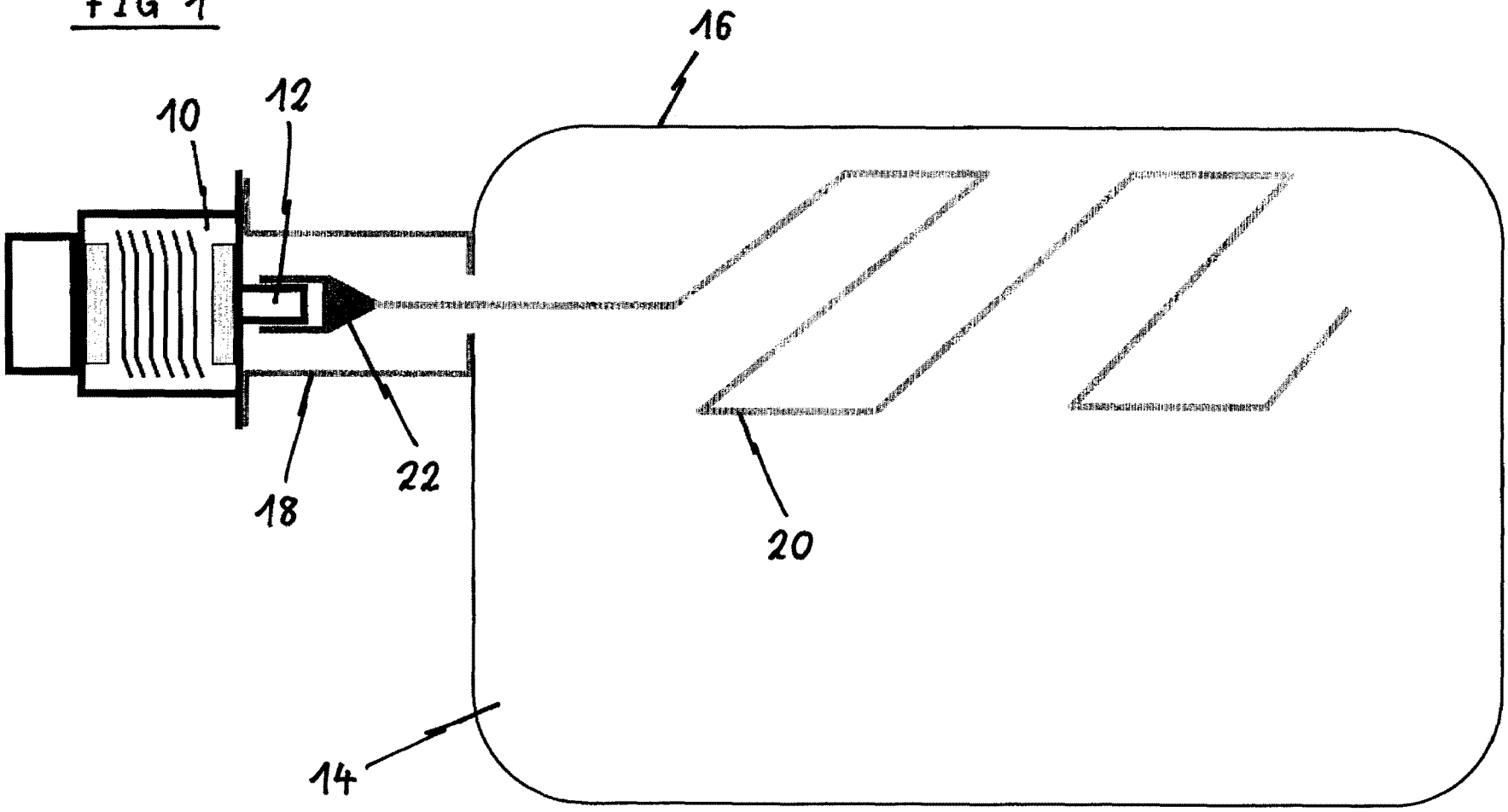
Figure 2:
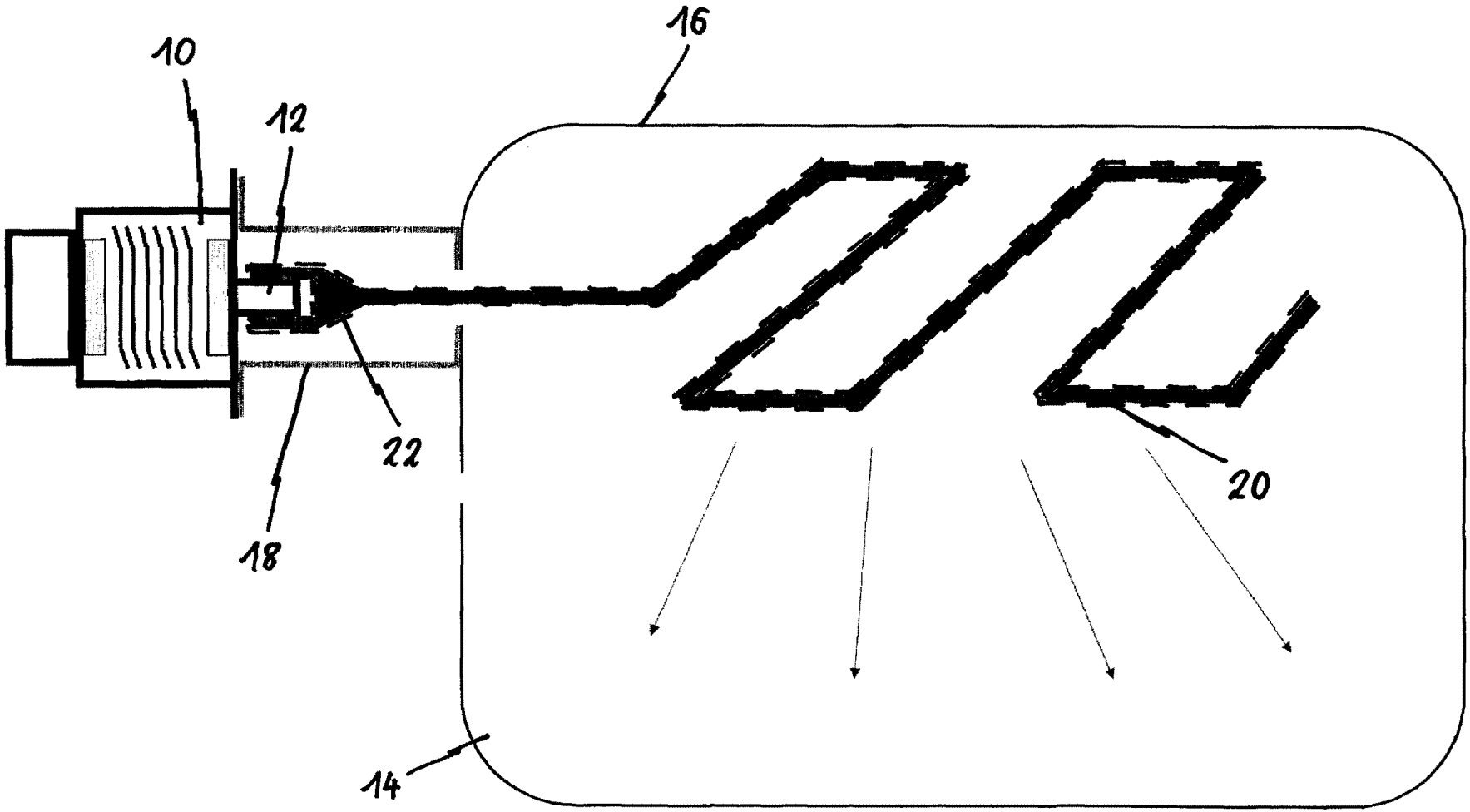
Figure 3:
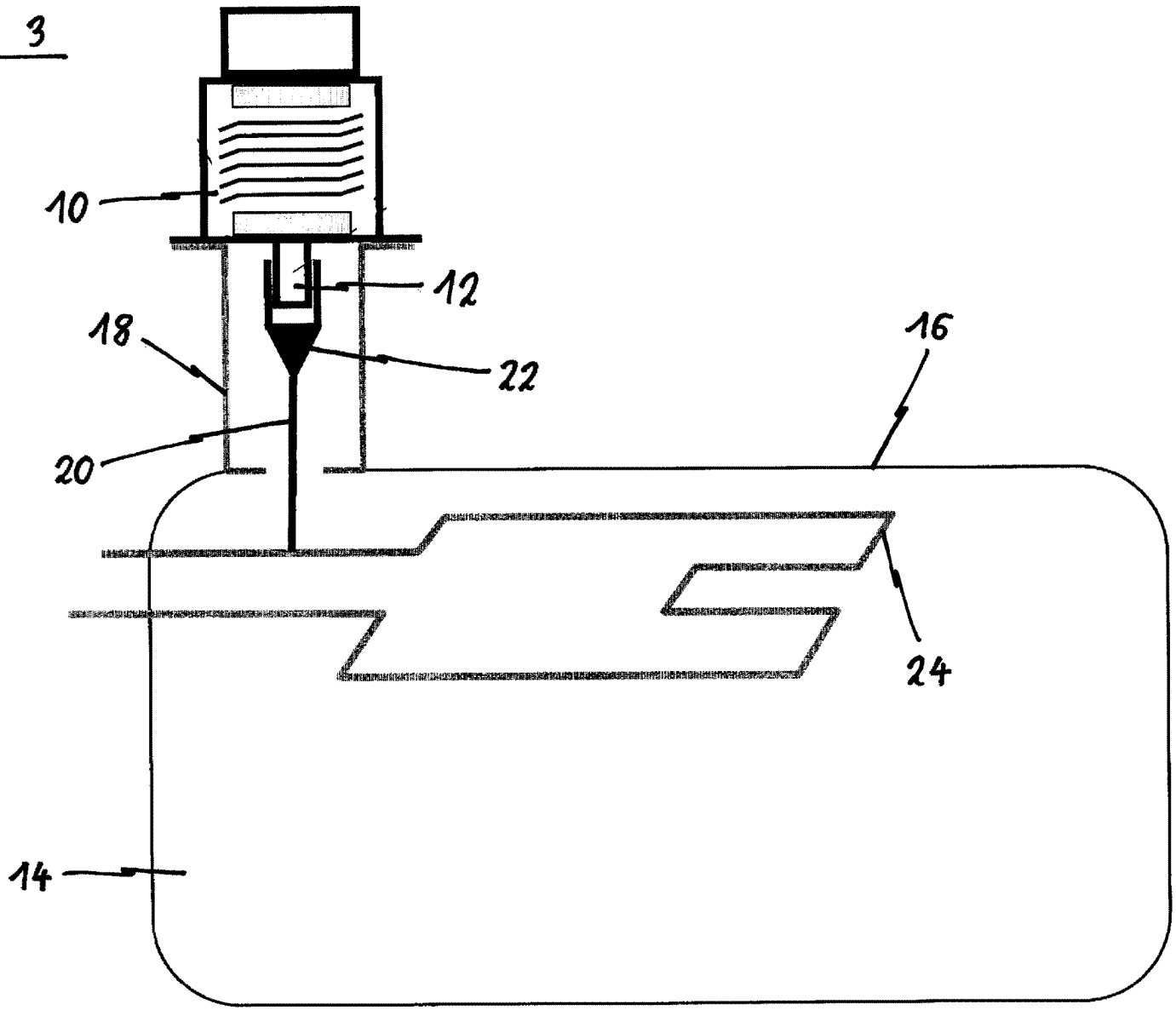
Figure 4:
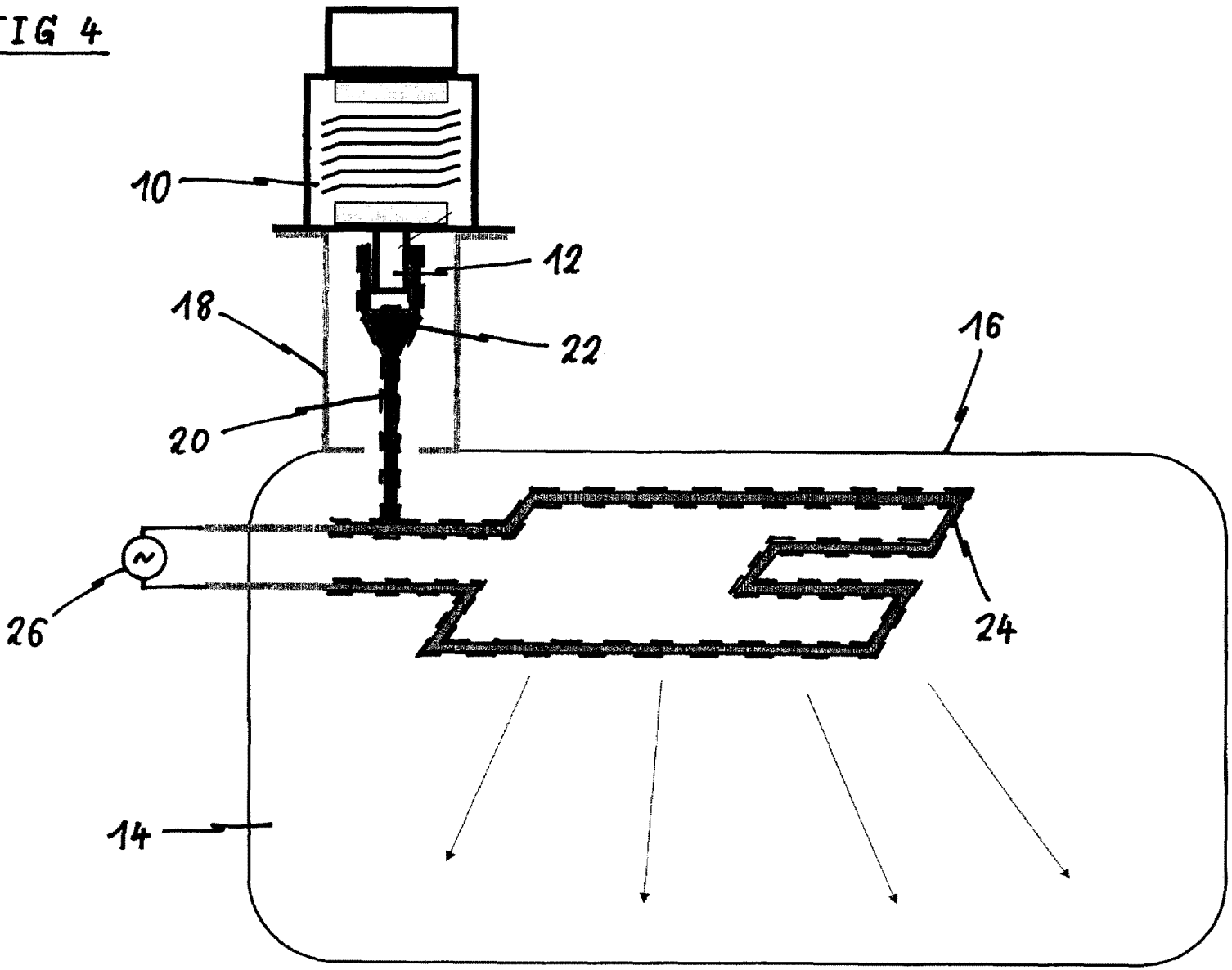
Figure 5:
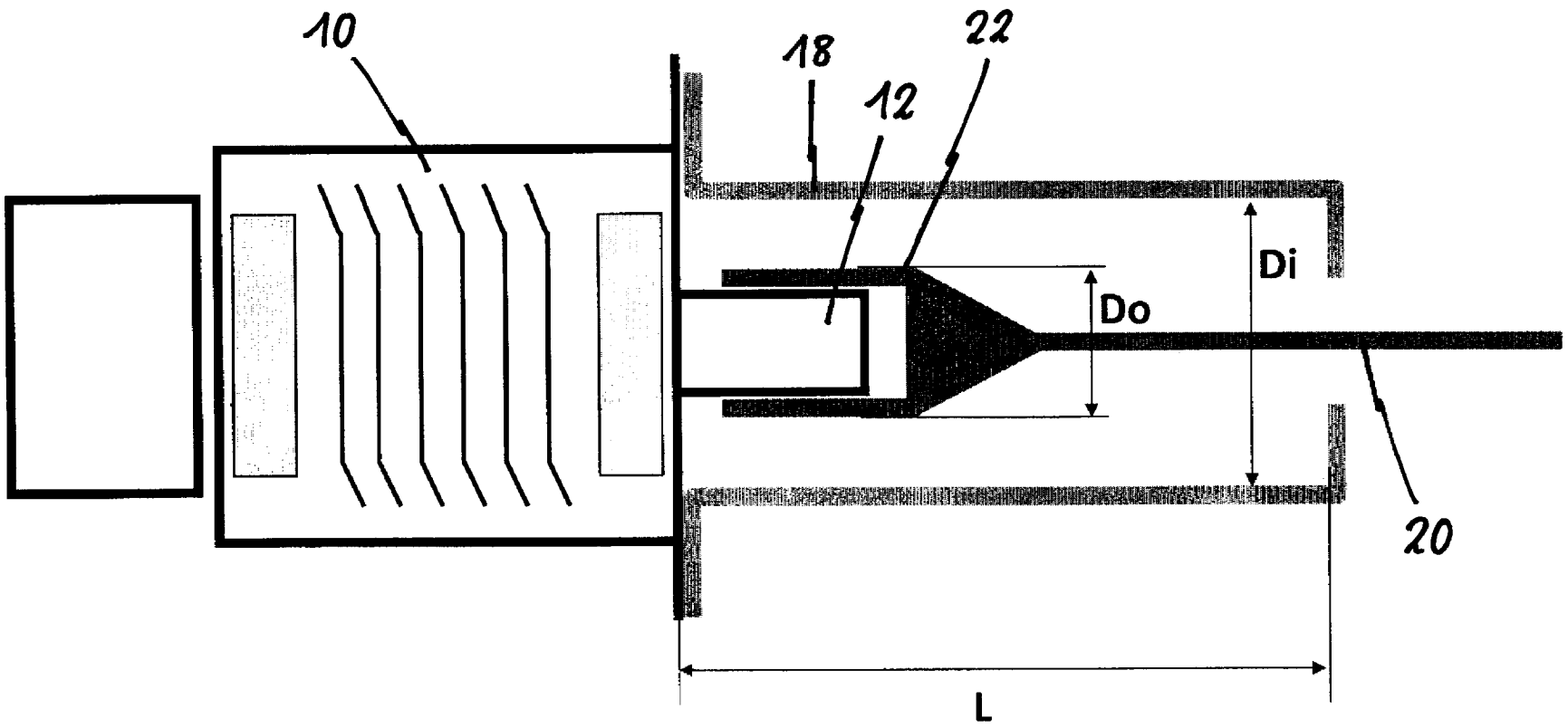
Figure 6:
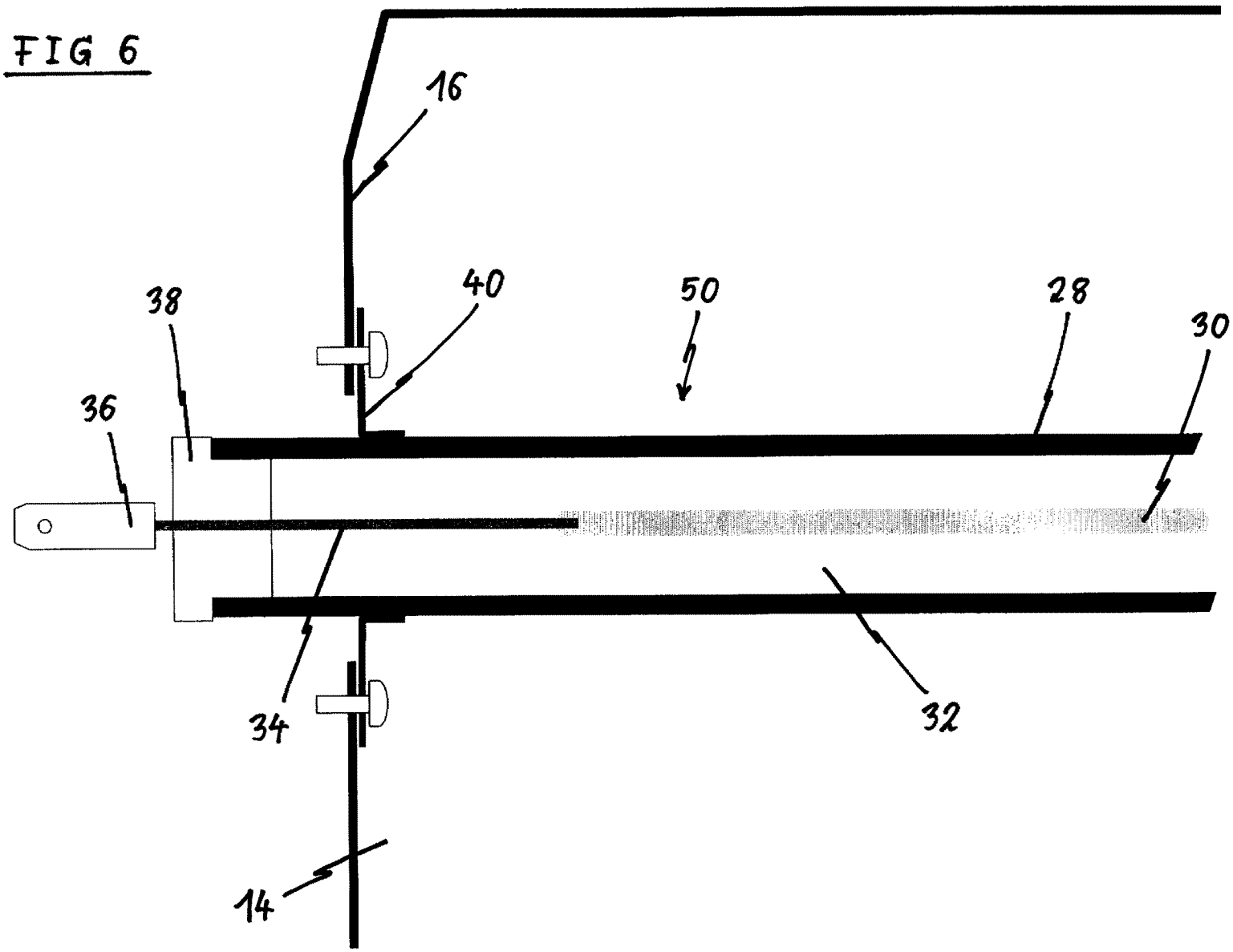
Figure 7:
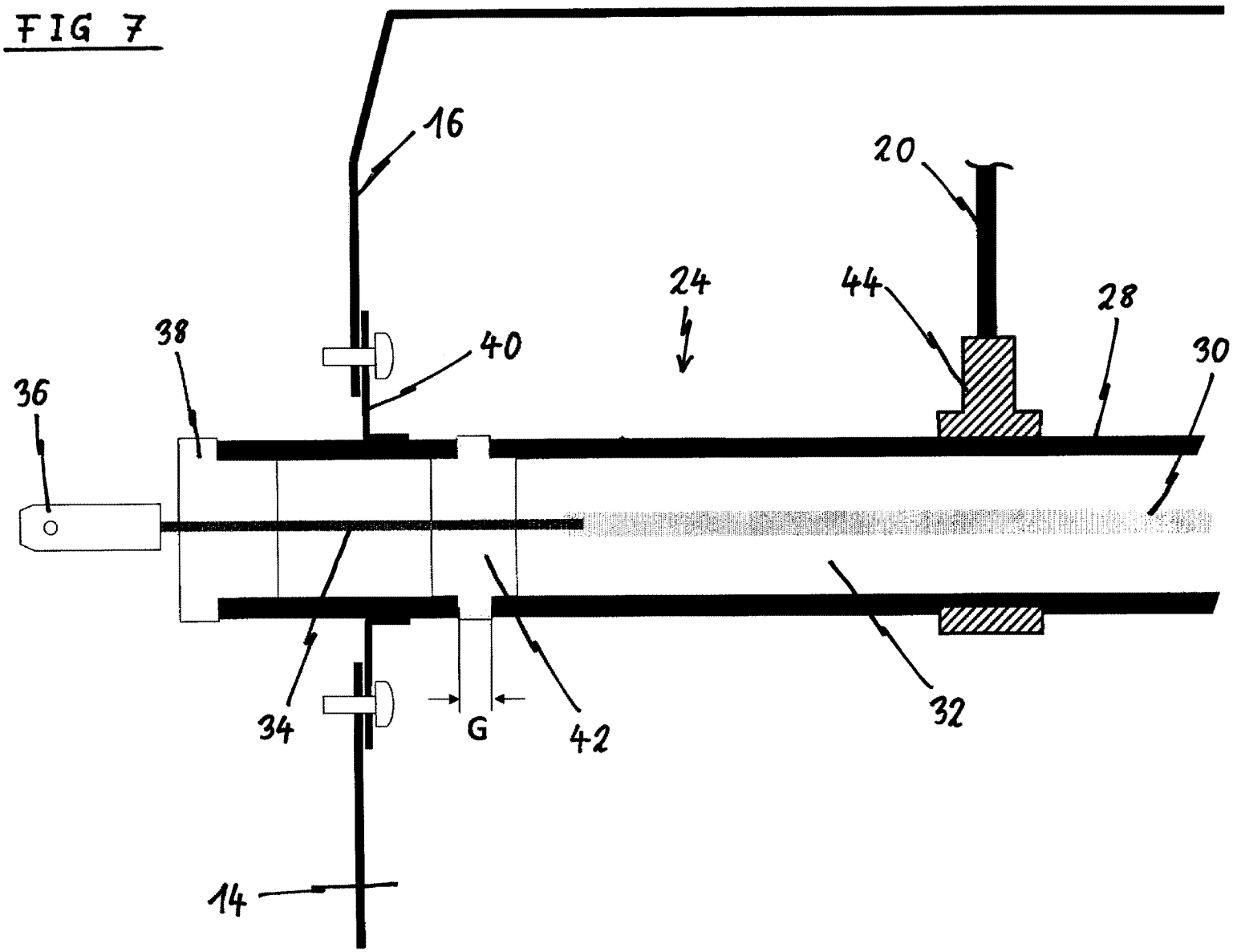
Figure 8:
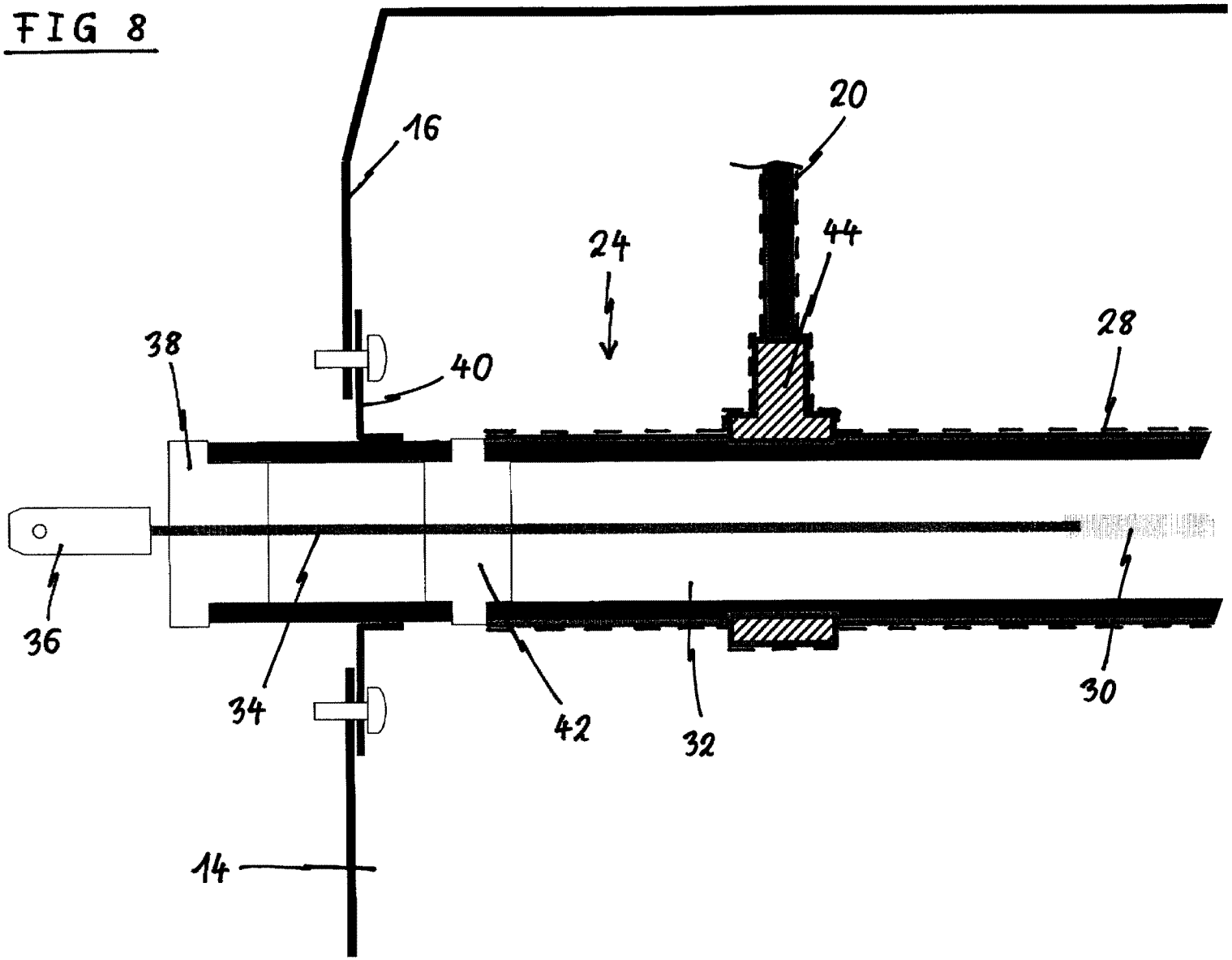
Figure 10:
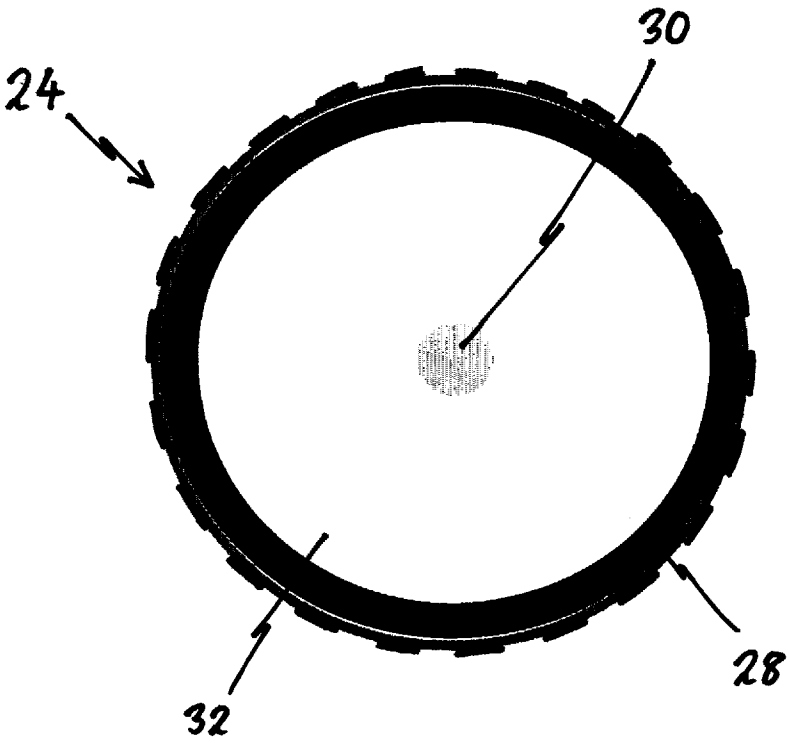
Figure 9:
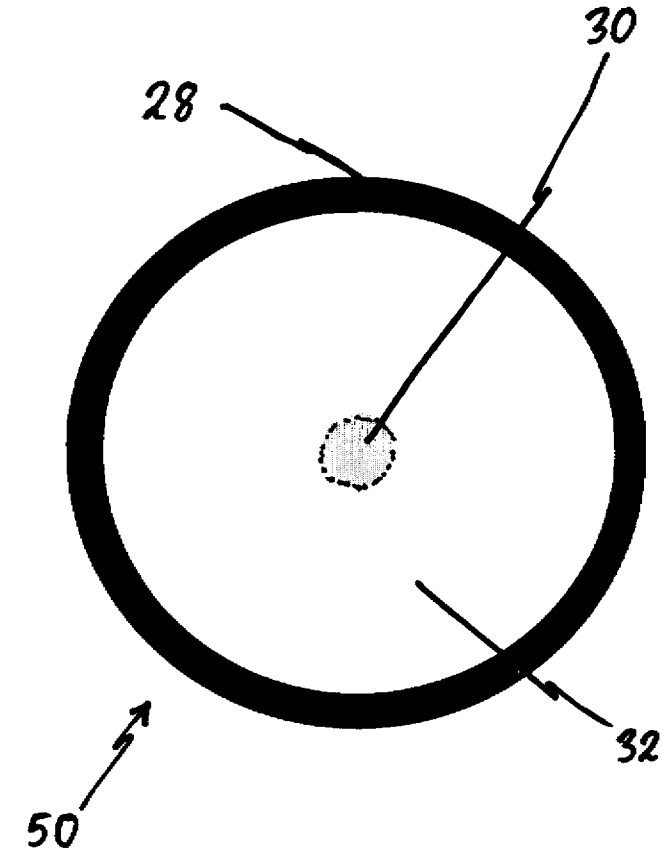

The present invention will be described in further detail with reference to the drawings, in which FIG. 1 illustrates a schematic sectional side view of a microwave oven according to a first embodiment of the present invention, FIG. 2 illustrates a schematic sectional side view of the microwave oven according to the first embodiment of the present invention, FIG. 3 illustrates a schematic sectional side view of the microwave oven according to a second embodiment of the present invention, FIG. 4 illustrates a schematic sectional side view of the microwave oven according to the second embodiment of the present invention, FIG. 5 illustrates a schematic detailed sectional side view of a magnetron and a matching section of the microwave oven according to the first and second embodiments of the present invention, FIG. 6 illustrates a schematic detailed sectional side view of a conventional grill heating element arranged at a cavity wall of the oven cavity of the microwave oven, FIG. 7 illustrates a schematic detailed sectional side view of a grill heating element arranged at the cavity wall of the oven cavity of the microwave oven according to the second embodiment of the present invention, FIG. 8 illustrates a schematic detailed sectional side view of the grill heating element arranged at the cavity wall of the oven cavity of the microwave oven according to the second embodiment of the present invention, FIG. 9 illustrates a schematic cross sectional view of the conventional grill heating element, FIG. 10 illustrates a schematic cross sectional view of the grill heating element of the microwave oven according to the second embodiment of the present invention, FIG. 11 illustrates a schematic sectional side view of an example of the microwave oven according to the prior art, and FIG. 12 illustrates a schematic sectional side view of a further example of the microwave oven according to the prior art.

FIG. 1 illustrates a schematic sectional side view of a microwave oven according to a first embodiment of the present invention.

The microwave oven comprises a microwave generator 10, e.g. a magnetron 10 and a microwave antenna 12, e.g. a magnetron antenna 12, wherein said microwave/magnetron antenna 12 extends from the microwave generator/magnetron 10. Alternatively, instead of the magnetron 10 the microwave oven may comprise other kinds of electromagnetic field sources, in particular dipole or monopole sources. In particular, any vacuum tube-type microwave generator such as e.g. a magnetron or any electronic microwave generator such as e.g. a solid state generator. Further, the microwave oven comprises an oven cavity 14 and a cavity wall 16 enclosing said oven cavity 14. The microwave generator/magnetron 10 is arranged out of the oven cavity 14. A matching section 18 is interconnected between the microwave generator/magnetron 10 and an opening in the cavity wall 16. The microwave/magnetron antenna 12 extends into said matching section 18. The matching section 18 may have a cylindrical, oval, rectangular or other cross section.

Moreover, the microwave oven comprises an antenna extension 20 arranged substantially inside the oven cavity 14, preferably in the upper part of said oven cavity 14. The antenna extension 20 is electrically connected to the magnetron antenna 12 via an antenna cap 22. A blind hole of the antenna cap 22 receives the magnetron antenna 12 in order to assure a tight mechanical and electrical connection. The antenna extension 20 is formed as a serpentine. In this example, the cross section of the antenna extension 20 may be of an arbitrary shape, e.g. square, rectangular, circular or oval. The antenna extension 20 may be hollow or solid. At least the most external surface of the antenna extension 20 must be made of an electrically conductive material, e.g. metal, in order to allow a propagation of the high frequency electromagnetic field. Preferably, the antenna extension 20 is a hollow cylinder made of copper or steel.

The shape, the length and the distance from other metal surfaces of the antenna extension 20 have to be defined in order to obtain the best matching condition of the microwave generator/magnetron 10 on the one hand and to change or modify the distribution of the electromagnetic field in the oven cavity 14 on the other hand. In the preferred embodiment, the distance between the antenna extension 20 and any other metal surfaces is about $\lambda/8$, wherein $\lambda$ is the wavelength of the microwaves.

The antenna extension 20 allows an improved control of the microwave heating distribution in the oven cavity 14 without any moving elements, like stirrers or turntables. Further, the antenna extension 20 saves space in the microwave oven. Moreover, only a small opening in the cavity wall 16 is required, which improves the insulation of the oven cavity 14.

FIG. 2 illustrates a schematic sectional side view of the microwave oven according to the first embodiment of the present invention in a similar way as in FIG. 1. Additionally, the surfaces delivering the microwaves are represented by dotted lines. The microwaves are delivered at the surfaces of the antenna cap 22 and the antenna extension 20.

FIG. 3 illustrates a schematic sectional side view of the microwave oven according to a second embodiment of the present invention.

The microwave oven comprises the microwave generator 10, e.g. the magnetron 10 and the microwave antenna 12, e.g. the magnetron antenna 12. Said Microwave/magnetron antenna 12 extends from the MW-generator/magnetron 10. Alternatively, instead of the magnetron 10 the microwave oven may comprise other kinds of electromagnetic field sources, in particular dipole or monopole sources. In particular, any vacuum tube-type microwave generator such as e.g. a magnetron or any electronic microwave generator such as e.g. a solid state generator. Further, the microwave oven comprises the oven cavity 14 and the cavity wall 16 enclosing said oven cavity 14. The mw-generator/magnetron 10 is arranged out of the oven cavity 14. The matching section 18 is interconnected between the mw-generator/magnetron 10 and the opening in the cavity wall 16. The microwave/magnetron antenna 12 extends into said matching section 18. The matching section 18 may have a cylindrical, oval, rectangular or other cross section.

The microwave oven comprises the antenna extension 20 arranged inside the matching section 18 and the oven cavity 14. The antenna extension 20 penetrates an opening in the cavity wall 16. The antenna extension 20 is electrically connected to the magnetron antenna 12 via the antenna cap 22. The blind hole of the antenna cap 22 receives the microwave/magnetron antenna 12 in order to assure a tight mechanical and electrical connection. In this embodiment, the antenna extension 20 is formed as a linear rod. The cross section of the antenna extension 20 may be of an arbitrary shape, e.g. square, rectangular, circular or oval. The antenna extension 20 may be hollow or solid.

The microwave oven according to the second embodiment comprises a further antenna extension 24. In this example, the further antenna extension 24 is formed as a grill heating element 24. The antenna extension 20 is electrically interconnected between the antenna cap 22 and the further antenna extension 24. The shape, the length and the distance from other metal surfaces of the further antenna extension 24 have to be defined in order to obtain the best matching condition of the microwave generator/magnetron 10, to change or modify the distribution of the electromagnetic field in the oven cavity 14 and to accomplish the original function of the further antenna extension 24, i.e. as the grill heating element 24. In the preferred embodiment, the distance between the further antenna extension 24 and any other metal surfaces is about $\lambda/8$, wherein $\lambda$ is the wavelength of the microwaves.

FIG. 4 illustrates a schematic sectional side view of the microwave oven according to the second embodiment of the present invention in a similar way as in FIG. 3. Additionally, the surfaces delivering the microwaves are represented by dotted lines. The microwaves are delivered by the surfaces of the antenna cap 22, the antenna extension 20 and the grill heating element 24. The grill heating element 24 is connected to power supply 26 providing the power for the grilling function.

FIG. 5 illustrates a schematic detailed sectional side view of the microwave generator 10, e.g. the magnetron 10 and the matching section 18 of the microwave oven according to the first and second embodiments of the present invention.

The matching section 18 is interconnected between the magnetron 10 and the opening in the cavity wall 16. The microwave antenna/magnetron antenna 12 extends from the microwave generator 10, e.g. the magnetron 10 and is arranged inside the matching section 18. The antenna extension 20 is electrically connected to the mw/magnetron antenna 12 via the antenna cap 22. The blind hole of the antenna cap 22 receives the mw/magnetron antenna 12 in order to assure a tight mechanical and electric connection. An outer diameter Do of the antenna cap 22, an inner diameter Di of the matching section 18 and a length L of the matching section 18 are essentially integer multiples of $\lambda/8$, i.e. $N*\lambda/8$ wherein N is an essentially integral number greater zero, preferably wherein N is essentially 1, 2 or 3, still preferably wherein N is essentially 1.

FIG. 6 illustrates a schematic detailed sectional side view of a conventional grill heating element 50 arranged at the cavity wall 16 of the oven cavity 14 of the microwave oven.

The grill heating element 50 includes an outer sheath 28, a heating coil 30 and an insulation powder 32. The heating coil 30 extends inside the outer sheath 28. The heating coil 30 and the outer sheath 28 are arranged coaxially to each other. The inner space of the outer sheath 28 is filled with the insulation powder 32. Said insulation powder 32 guarantees the proper insulation between the outer sheath 28 and the heating coil 30. The outer sheath 28 is formed as a metal pipe, preferably made of steel or copper or aluminium.

Further, the grill heating element 50 includes a metal conductor 34, a connector 36, a sealing cap 38 and a flange 40. The metal conductor 34, the connector 36, the sealing cap 38 and the flange 40 are arranged within the range of an opening in the cavity wall 16 of the oven cavity 14. An end portion of the grill heating element 50 penetrates said opening. The sealing cap 38 is arranged out of the oven cavity 14 and closes the end of the outer sheath 28. The metal conductor 34 extends linearly, forms the continuation of the heating coil 30 and penetrates the sealing cap 38. The connector 36 is fixed at an outer end of the metal conductor 34. Via the connector 36 the grill heating element 50 is connectable to the power supply 26. For example, the connector 36 is a faston. The flange 40 encloses the outer sheath 28 and is fixed at the cavity wall 16, so that the grill heating element 50 is fastened by the flange 40 at the cavity wall 16. The heating coil 30 generates heat, while the metal conductor 34 does not generate any appreciable heat.

FIG. 7 illustrates a schematic detailed sectional side view of a grill heating element 24 arranged at the cavity wall 16 of the oven cavity 14 of the microwave oven according to the second embodiment of the present invention. The grill heating element 24 according to the present invention includes also the outer sheath 28, the heating coil 30, the insulation powder 32, the metal conductor 34, the connector 36, the sealing cap 38 and the flange 40.

However, the outer sheath 28 is divided into an inner part and two outer parts, wherein only one inner part is shown. The inner part of the outer sheath 28 is arranged in the central portion of the oven cavity 14, while the outer parts of the outer sheath 28 penetrate the cavity wall 16. A gap is formed between the inner part and the outer part of the outer sheath 28. Said gap extends perpendicular to the longitudinal axis of the outer sheath 28 and is filled by a separating element 42. Further, the inner part and the outer part of the outer sheath 28 are connected by the separating element 42. The separating element 42 is made of an insulating material, so that the inner part and the outer part of the outer sheath 28 are electrically isolated from each other. The metal conductor 34 inside the outer sheath 28 also penetrates the separating element 42. The width G of the gap is as small as possible in order to allow the electrical separation of the inner part and the outer part of the outer sheath 28 on the one hand and to shield the metal conductor 34 from the microwaves on the other hand. Preferably, the width G of the gap is between 1 mm and 2 mm. The inner part of the outer sheath 28 is connected to the antenna extension 20 via a connecting element 44.

FIG. 8 illustrates a schematic detailed sectional side view of the grill heating element arranged at the cavity wall 16 of the oven cavity 14 of the microwave oven according to the second embodiment of the present invention in a similar way as in FIG. 7. Additionally, the surfaces delivering the microwaves are represented by dotted lines. The microwaves are delivered by the surfaces of the antenna extension 20, the connecting element 44 and the inner part of the outer sheath 28 of the grill heating element 24. Since the outer part of the outer sheath 28 is isolated from the inner part of the outer sheath 28 by the separating element 42, the microwaves are not delivered by the outer part of the outer sheath 28.

FIG. 9 illustrates a schematic cross sectional view of the conventional grill heating element 50. FIG. 9 clarifies that the heating coil 30 and the outer sheath 28 are arranged coaxially to each other. The inner space of the outer sheath 28 is filled with the insulation powder 32, so that the proper insulation between the outer sheath 28 and the heating coil 30 is guaranteed.

FIG. 10 illustrates a schematic cross sectional view of the grill heating element 24 of the microwave oven according to the second embodiment of the present invention. The inner part of the grill heating element 24 has substantially the same structure as the conventional grill heating element 50. The outer surface of the outer sheath 28 delivers the microwaves. Said surface is represented by dotted lines.

FIG. 11 illustrates a schematic sectional side view of an example of the microwave oven according to the prior art. The microwave oven comprises the microwave generator 10, e.g. the magnetron 10 and the microwave antenna 12, e.g. the magnetron antenna 12 extending from said mw-generator/magnetron 10. Further, the microwave oven comprises the oven cavity 14 and the cavity wall 16 enclosing said oven cavity 14. The mw-generator/magnetron 10 is arranged out of the oven cavity 14. The matching section 18 is interconnected between the mw-generator/magnetron 10 and the cavity wall 16. The matching section 18 is arranged upon the top wall of the oven cavity 14. The microwave antenna/magnetron antenna 12 extends into said matching section 18. A wave stirrer 46 is arranged inside the matching section 18 and above a large opening in the top wall of the oven cavity 14.

FIG. 12 illustrates a schematic sectional side view of a further example of the microwave oven according to the prior art. The microwave oven comprises the microwave generator 10, e.g. the magnetron 10, the microwave antenna 12, e.g. the magnetron antenna 12 extending from said mw-generator/magnetron 10, the oven cavity 14 and the cavity wall 16 enclosing said oven cavity 14. The mw-generator/magnetron 10 is arranged out of the oven cavity 14. The matching section 18 is interconnected between the mw-generator/magnetron 10 and a large opening in a side wall of the oven cavity 14. The mw-antenna/magnetron antenna 12 extends into said matching section 18. A turntable 48 is arranged on the bottom of the oven cavity 14.

The microwave ovens of the prior art shown in FIGS. 11 and 12 require a movable component as the wave stirrer 46 and the turntable 48, respectively, in order to improve the microwave heat distribution. Further, the microwave ovens of the prior art require large openings in the cavity wall 16. Said large openings reduce the thermal insulation of the oven cavity 14.

In contrast, the microwave oven according to the present invention is realized without any moveable components. The inventive microwave oven provides more space in the oven cavity 14. Further, the inventive microwave oven comprises a relative small opening in the cavity wall 16. Said small opening improve the thermal insulation of the oven cavity 14. Moreover, the inventive microwave oven does not require any complex wave guides.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 microwave generator, e.g. magnetron
12 microwave antenna, e.g. magnetron antenna
14 oven cavity
16 cavity wall
18 matching section
20 antenna extension
22 antenna cap
24 further antenna extension, grill heating element
26 power supply
28 outer sheath
30 heating coil
32 insulating powder
34 metal conductor
36 connector
38 sealing cap
40 flange element
42 separating element
44 connecting element
46 wave stirrer
48 turntable
50 conventional grill heating element
Do outer diameter of the antenna cap 22
Di inner diameter of the matching section 18
L length of the matching section 18
G width of the gap of the outer sheath

The invention claimed is:

1. A microwave oven, comprising:
an oven cavity at least partially enclosed by a cavity wall,
a microwave generator arranged out of the oven cavity,
a matching section interconnected between the microwave generator and the cavity wall, the matching section covering an opening in the cavity wall,
a microwave antenna extending from the microwave generator into the matching section,
at least one first antenna extension arranged inside the oven cavity, the first antenna extension penetrating the opening in the cavity wall, and being electrically connected to the microwave antenna, and
at least one further antenna extension arranged inside the oven cavity, wherein said further antenna extension is electrically connected to the first antenna extension.

2. The microwave oven according to claim 1, wherein an antenna cap is interconnected between the microwave antenna and the first antenna extension, wherein preferably the antenna cap includes a blind hole for receiving the microwave antenna.

3. The microwave oven according to claim 1, wherein the first antenna extension is arranged inside an upper portion of the oven cavity.

4. The microwave oven according to claim 1, wherein the first antenna extension is arranged in a plane parallel to and beneath a top wall of the oven cavity.

5. The microwave oven according to claim 4, the distance between the first antenna extension and the top wall of the oven cavity being $N \times \lambda/8$, wherein $\lambda$ is the wavelength of the microwaves and N is an essentially integral number greater zero.

6. The microwave oven according to claim 5, wherein N is essentially 1, 2 or 3.

7. The microwave oven according to claim 1, wherein an outer diameter of the antenna cap, an inner diameter of the matching section and/or a length (L) of the matching section is N×λ/8, wherein λ is the wavelength of the microwaves and N is an essentially integral number greater zero.

8. The microwave oven according to claim 1, wherein at least an outer surface of the first antenna extension is made of electrically conductive material.

9. The microwave oven according to claim 1, wherein the cavity wall of the oven cavity is grounded.

10. The microwave oven according to claim 1, wherein the further antenna extension is an electric heating element arranged in a plane parallel to and beneath a top wall of the oven cavity, and wherein the distance between the further antenna extension and the top wall of the oven cavity is N×λ/8, wherein λ is the wavelength of the microwaves and N is an essentially integral number greater zero.

11. The microwave oven according to claim 1, wherein the further antenna extension includes a tubular outer sheath and an elongated electric heating coil arranged inside said outer sheath, wherein at least a part of the outer sheath is electrically connected to the first antenna extension and said heating coil is connected or connectable to a power supply.

12. The microwave oven according to claim 11, wherein the further antenna extension includes an insulating powder inside the outer sheath, so that the heating coil and the outer sheath are electrically isolated from each other.

13. The microwave oven according to claim 12, wherein the outer sheath includes an inner part and two outer parts, wherein the inner part is arranged inside the oven cavity and the outer parts penetrate the cavity wall, and wherein the inner part is electrically connected to the first antenna extension and the outer parts are electrically connected to the cavity wall.

14. The microwave oven according to claim 13, wherein the inner part and the outer part are connected by a separating element made of one or more insulating materials.

15. The microwave oven according to claim 14, wherein each said outer part of the outer sheath is enclosed by a flange connected or connectable to the cavity wall of the oven cavity.

16. The microwave oven according to claim 14, wherein a connecting element is interconnected between the inner part of the outer sheath and the first antenna extension.

17. A microwave oven comprising: an oven cavity at least partially enclosed by a cavity wall; a microwave generator arranged outside said oven cavity; a microwave antenna extending from the microwave generator; an antenna extension electrically coupled to the microwave antenna and penetrating said cavity wall through a small opening therein in order to deliver microwave energy generated by said microwave generator into said oven cavity, at least an outer surface of said antenna extension comprising electrically conductive material; at least one further antenna extension arranged inside the oven cavity, wherein said further antenna extension is electrically connected to the first antenna extension; said microwave oven being devoid any turntable for rotating food to be cooked and any stirrer for distributing said microwave energy within said oven cavity.

18. The microwave oven according to claim 17, wherein the further antenna extension is a grill heating element; said grill heating element comprising a metal outer sheath that is electrically connected to said antenna extension within said oven cavity in order to emit said microwave energy within said oven cavity, a heating coil extending coaxially within said outer sheath and insulation disposed between said outer sheath and said heating coil; said heating coil being electrically connected with a power supply located outside said oven cavity for generating heat within said oven cavity independent of said outer sheath; said grill heating element being disposed a distance of λ/8 from any other metal surfaces within said oven cavity, wherein X is the wavelength of said microwave energy.

19. A microwave oven comprising: an oven cavity at least partially enclosed by a cavity wall; a microwave generator arranged outside said oven cavity; a microwave antenna extending from the microwave generator; an antenna extension electrically coupled to the microwave antenna and penetrating said cavity wall through a small opening therein in order to deliver microwave energy generated by said microwave generator into said oven cavity, at least an outer surface of said antenna extension comprising electrically conductive material; said microwave oven being devoid any turntable for rotating food to be cooked and any stirrer for distributing said microwave energy within said oven cavity, said antenna extension following a planar serpentine path within, and being arranged parallel to an upper wall of, said oven cavity; said antenna extension being spaced from said upper wall by a distance essentially equal to a non-zero integer multiple of λ/8 wherein λ is the wavelength of said microwave energy.

* * * * *